US005116267A

United States Patent [19]

Olson

[11] Patent Number: 5,116,267

[45] Date of Patent: May 26, 1992

[54] YIELDABLE PROTECTIVE MOUNT FOR TROLLING MOTORS

[76] Inventor: Richard J. Olson, 11410 Sharpcrest, Houston, Tex. 77072

[21] Appl. No.: 697,964

[22] Filed: May 10, 1991

[51] Int. Cl.[5] ..... B63H 5/12

[52] U.S. Cl. ..... 440/56; 248/642; 248/586

[58] Field of Search ..... 440/53, 55, 56, 63, 440/6, 7; 248/586, 642

[56] References Cited

U.S. PATENT DOCUMENTS

| | | | |
|---|---|---|---|
| 3,915,417 | 10/1975 | Norton et al. | 440/56 |
| 4,033,530 | 7/1977 | Harris | 440/56 |
| 4,555,233 | 11/1985 | Klammer et al. | 440/56 |
| 4,734,068 | 3/1988 | Edwards | 440/56 |

*Primary Examiner*—Jesûs D. Sotelo

[57] ABSTRACT

A yieldable protective mounting mechanism for trolling motors incorporates a mounting base that is fixed to the deck structure or the stern structure of a small boat such as is typically used for recreational activities such as fishing. A motor support element is pivotally connected by hinge structure to the base and is continuously urged by tension springs to an operating position where the trolling motor is positioned for its normal operation. In the event the trolling motor should strike a submerged object, the tension springs permit pivotal movement of the trolling motor to prevent it from being overstressed and bent or otherwise damaged. The tension springs also provide a braking force to the boat causing the boat to come to a complete stop from its slow movement so that the motor can be reversed and the boat and trolling motor backed clear of the submerged object. This yieldable protective trolling motor mount may be positioned at the bow or stern of a fishing boat as is desired, there being only slight modification in structure but essentially identical function in use.

16 Claims, 3 Drawing Sheets

YIELDABLE PROTECTIVE MOUNT FOR TROLLING MOTORS

FIELD OF THE INVENTION

This invention relates generally to trolling motor mechanisms such as are utilized during recreational fishing activities for propelling fishing boats at slow speeds to enable fishermen to quietly cover selective fishing areas. More particularly, the present invention is related to a yieldable protective mounting mechanism that is adapted for assembly to the structure of a boat, either at the bow or stern thereof, and which provides yieldable support for a trolling motor to enable yieldable pivoting of the trolling motor in the event submerged objects are struck thereby, so as to provide protection against bending of the trolling motor shaft or other damage to the trolling motor mechanism.

BACKGROUND OF THE INVENTION

Trolling motors are widely utilized in recreational fishing activities to enable fisherman to propel fishing boats quietly at slow speeds to thereby enable fishermen to cover areas of lakes, streams, bays, etc. and to engage in fishing activities during propulsion of the boat. Typically trolling motors are provided with a bracket for attachment to the bow or stern of a fishing boat or other such vessel and have an elongate shaft extending through the motor support bracket with an electric motor and propeller mechanism fixed at the lower end of the shaft. In most cases the motor shaft is vertically slidable within the motor support bracket so that the electric motor and propeller may be set at any suitable depth in the water which is permitted by the length of the shaft and the height of the boat above the water line. Above the motor support bracket is generally provided a motor control and directional indicator to enable the fishermen or other users to control lateral orientation of the motor relative to the boat. In many, if not most cases, foot or hand operated electrical controls are provided which are easily accessible by the user so that fishing or other desired activities can be conducted continuously while the trolling motor mechanism is selectively energized and steered to propel the boat.

Many motor support brackets are provided with mechanisms that enable the trolling motor and shaft to be stowed above the level of the water in a generally horizontal position when not in use. Those trolling motor mounts that are adapted to be fixed to the bow of the boat are generally quite complex and expensive because the bow of small fishing and pleasure boats is not ordinarily provided with a trolling motor mounting bracket. The motor mount for bow mounted trolling motors is quite complex in construction because motor support positioning and stowage is typically built into the mount. U.S. Pat. Nos. 3,915,417, 3,948,472 and 4,033,530 are exemplary of complex bow mounts for trolling motors. Some of these trolling motor mount mechanisms additionally enable pivoting or other movement of portions of the trolling motor mechanism in the event a submerged object is struck. For the most part, however, these mechanisms are quite complex in nature and are quite expensive. Therefore, in order to minimize the expense of trolling motors for boats, even though bow mounted trolling motors are preferable to the stern mounted type from the standpoint of boat control, many fishermen and other small boat users employ very simple and low cost trolling motor assemblies that incorporate simple clamp type motor support brackets which are designed for clamped assembly to the transom at the stern of a boat.

In most cases clamp type stern mounting brackets, in the operative position of the trolling motor, fix the trolling motor with its shaft disposed in substantially vertical position so that the motor shaft is rotatable relative to its mounting bracket but not pivotal. These types of non-pivotal trolling motor mount mechanisms, though being of quite simple and low cost nature, do not provide any protection against shaft bending or motor damage when a submerged object is struck. It is desirable, therefore, to provide a trolling motor mount that is not a component part of a trolling motor mechanism and which is capable of providing yieldable protective support for virtually all types of trolling motor mechanisms to thereby provide the trolling motor with protective yielding pivotal movement when a submerged object is struck to minimize the possibility of damage to the trolling motor. It is also desirable to provide a trolling motor mount that is adapted to support a wide range of trolling motor types including those of simple stern mounted design and those of more complex bow mounted design whether mounted at the bow or stern of a boat.

It should be born in mind that most fishing activities that utilize trolling motor mechanisms for boat propulsion are conducted in conditions where it is very likely that the trolling motor will strike a submerged object such as a submerged tree, log, shoal, etc. Trolling motor damage such as the bending of trolling motor shafts when submerged objects are struck is a common occurrence that requires expensive repair of the trolling motor. It is desirable, therefore, to provide a trolling motor mount that effectively permits pivotal yielding movement of the trolling motor when a submerged object is struck to thereby minimize the possibility of damaging the trolling motor or bending the trolling motor shaft.

In the event a submerged object is encountered it is also desirable to provide a motor protection mounting system that permits automatic braking of the boat so that the boat, though traveling slowly, will be brought to a full stop in a relatively short distance and in a manner that does not overstress the motor shaft or other components of the trolling motor mechanism.

SUMMARY OF THE INVENTION

It is a primary feature of the present invention, therefore, to provide a novel protective trolling motor mount that is adapted to be fixed to the bow or stern of a fishing boat or other small marine vessel and which is adapted to receive and provide support for the mounting bracket of a trolling motor.

It is another feature of this invention to provide a novel protective, yielding trolling motor mount mechanism which permits pivotal yielding of the typically non-yielding clamp type trolling motor mounting bracket of a simple low cost trolling motor to thus minimize the application of forces to the trolling motor in the event a submerged object is struck and to thereby provide the trolling motor with protection against bending of its shaft or damage to its motor by the submerged object.

It is also a feature of this invention to provide a novel protective trolling motor mount incorporating a base that is adapted to be fixed to the bow or stern of the boat and a movable motor support structure which is pivotally assembled to the base and is spring-urged to normally position a trolling motor with its shaft oriented substantially vertically.

It is an even further feature of the present invention to provide a novel protective trolling motor mount assembly incorporating a motor support element that normally positions the trolling motor at its operative position and which is yieldable to permit damage resisting pivoting of the trolling motor in the event a submerged object is struck by the propulsion motor or its shaft.

It is another feature of this invention to provide a novel, protective, yieldable mount for trolling motors which may be selectively positioned at the bow or the stern of the fishing boat to thereby provide users with the capability of trolling motor operation from the bow or stern of the vessel as desired.

Among the several features of this invention is contemplated the provision of a novel protective yielding mount assembly for trolling motors which incorporates urging means which functions to position the trolling motor at its operative position, to permit protective cushioned pivotal yielding of the trolling motor in the event a submerged object is encountered and to provide a braking force to the boat to assist in halting its motion in the water in a manner that does not overstress the shaft or other components of the trolling motor mechanism.

Briefly, the various objects and features of the present invention are accomplished through the provision of a protective trolling motor mount mechanism having a base structure that is fixed by bolting or by any other suitable means to the bow or stern of the fishing vessel. To the base structure is pivotally mounted a motor support assembly having a mounting element, such as a mounting plate, that is adapted to receive the clamps or other attachment structure of a trolling motor support bracket. The trolling motor support element, including the support plate are pivotally connected to the base structure and are urged by yieldable means such as a tension spring or springs to an operative position wherein the shaft of the trolling motor, at its operative condition, is positioned in substantially vertical orientation. In one embodiment of the invention the motor support and motor support base cooperate to establish stops that position the trolling motor support plate in substantially vertically oriented manner at the operative position of the trolling motor. The motor support plate, and thus the trolling motor attached thereto, are supported at this operative position by the force of a spring system or other yielding means so that the trolling motor is properly positioned for its operation unless a potentially damaging force is being applied thereto by a submerged object. In the event a submerged object is struck by the trolling motor, the force being applied through the motor and shaft by the resistance of the submerged object will be transmitted to the motor bracket. From the motor bracket, this force is transmitted to the motor support plate and an opposing force is thus induced to the spring system which permits pivoting of the trolling motor about a pivot of the protective trolling motor mount. This pivoting movement prevents excessive force from being applied to the motor housing and shaft and thereby effectively protects the trolling motor shaft from being bent or otherwise damaged. The spring resistance of the trolling motor mount also transmits an opposing cushioning force to the boat thus halting movement of the boat in a relatively short distance without permitting the motor and motor shaft to be overstressed by application of forces thereto by the submerged object.

In another embodiment of the invention a mounting base in the form of a generally rectangular frame is adapted to be bolted or otherwise fixed to a boat. A motor support in the form of elongate structural members which may form a second frame is pivotally connected by a pivot pin to the mounting base and in the normal operating condition of the trolling motor is positioned in nesting, generally coplanar, and horizontal relation with the mounting base with the trolling motor mounting bracket being releasably connected or perhaps bolted to the motor support frame. Springs disposed in angular relation to both the mounting base and motor support frame, and connected to each apply a spring force that positions the motor support frame at a motor operating position relative to the mounting base. When a submerged object is struck by the trolling motor, the motor support frame is pivoted against the force of the springs thereby allowing protective pivoting of the trolling motor to protect the motor mechanism from damage and to impart a spring induced braking force to the boat.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a side elevational view representing a preferred embodiment of the present invention and showing in broken lines a trolling motor mechanism being positioned for normal operation.

FIG. 2 is a side elevational view similar to that of FIG. 1 and illustrating the trolling motor mount at its yielded position to permit protective pivoting of the trolling motor and trolling motor mounting bracket for protection of the trolling motor and trolling motor shaft from damage in the event a submerged object is struck during operation of the boat.

FIG. 3 is a side elevational view in partial section illustrating a preferred embodiment of the present invention and showing its pivotal motor support plate in operative position by way of full lines and in protective yielded position by way of broken lines.

FIG. 4 is a partial elevational view of the motor mount assembly of FIG. 3 showing the structural details of the motor mounting plate and its related structure.

FIG. 5 is a plan view of the trolling motor mount assembly of FIGS. 3 and 4 with the motor mounting plate being shown at its normal operative position.

FIG. 6 is a bottom view of a protective yieldable mount for trolling motors which represents an alternative embodiment of the present invention.

FIG. 7 is a plan view of the protective yieldable trolling motor mount shown in FIG. 6.

FIG. 8 is a side elevational view of the protective yieldable trolling motor mount shown in FIGS. 6 and 7.

DETAILED DESCRIPTION OF PREFERRED EMBODIMENT

Figure 1:
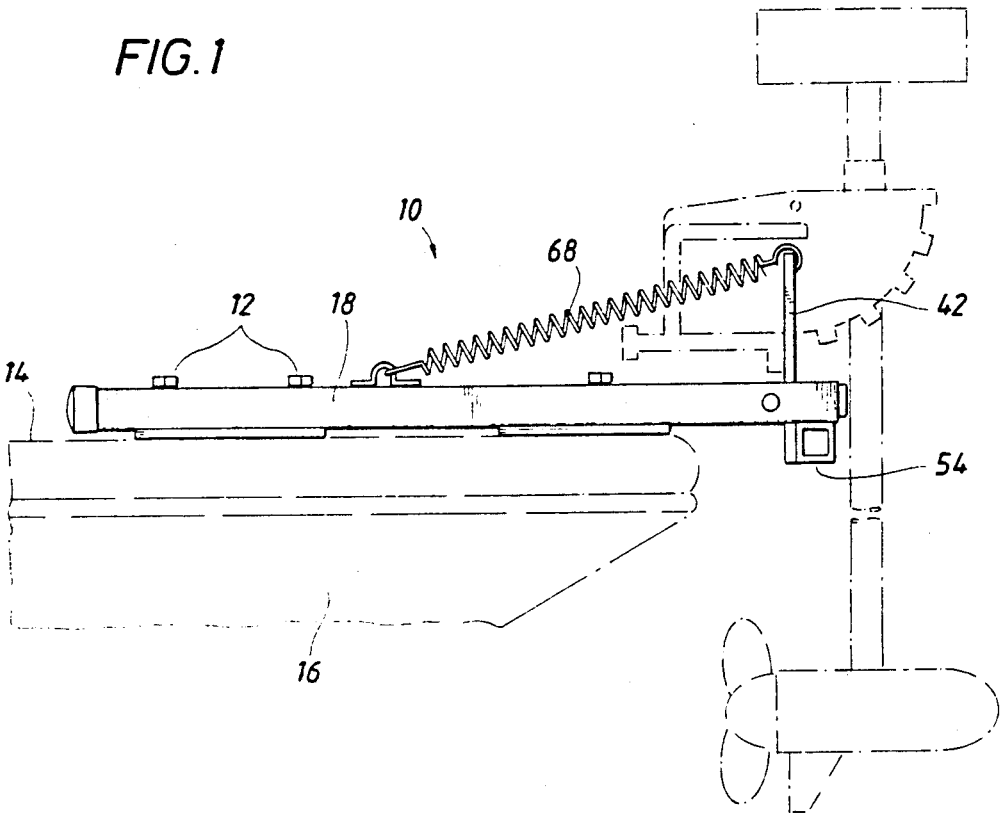
Figure 3:
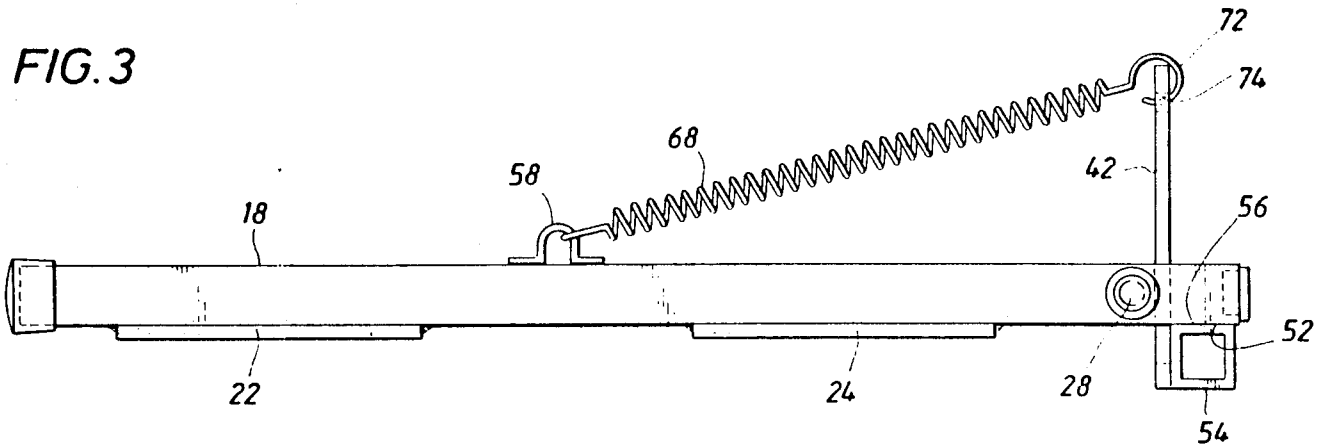
Figure 5:
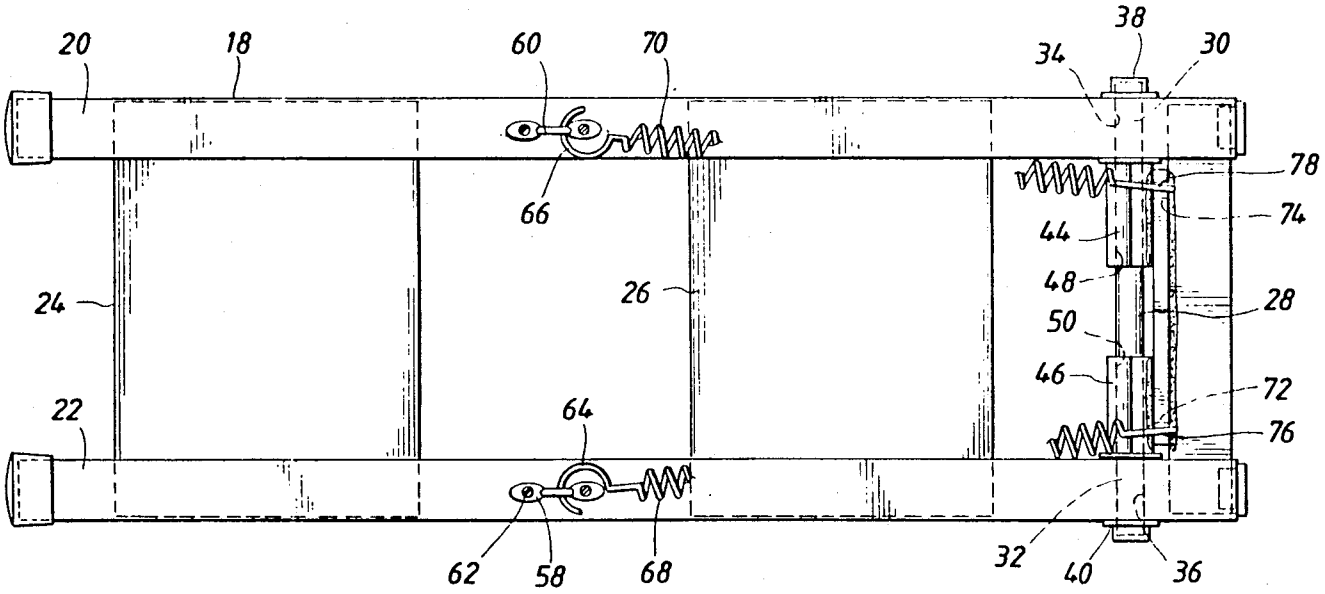

Referring now to the drawings and first to FIG. 1, a protective yieldable trolling motor mount, constructed in accordance with the present invention and representing a preferred embodiment thereof, is illustrated generally at 10 and is shown to be attached by a plurality of bolts 12 to the deck surface 14 of a small boat 16 such as a fishing boat. The trolling motor mount 10 includes a mounting base structure 18 which is typically of generally rectangular configuration as illustrated in FIGS. 3 and 5. The mounting base 18 of the embodiment shown in FIGS. 3 and 5 includes a pair of spaced generally parallel structural members 20 and 22 having transverse structural members 24 and 26 assembled thereto by bolting, welding or by any other suitable means of connection. The base structure 18 is thus rendered to a rigid form and is intended for immovable assembly to the structure of a boat.

At one end of the mounting base 18 is provided a hinge or pivot pin 28 having the opposed end portions 30 and 32 thereof received within transverse aligned apertures 34 and 36 of the structural members 20 and 22 respectively. The opposed ends of the hinge pin 28 receive push nuts 38 and 40 that secure the hinge pin in assembly with the base structure.

Figure 4:
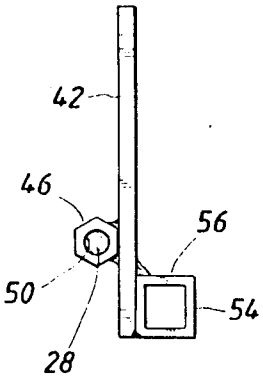

As shown in detail in FIG. 4, the motor mount assembly includes a motor mounting plate 42 which is typically composed of plate metal such as steel, aluminum, etc. To the motor mounting plate 42 is secured by welding or by any other suitable means, one or more hinge elements shown at 44 and 46. The hinge elements define aligned longitudinal bores 48 and 50 respectively which receive the hinge pin 28 therethrough. Thus, the motor mounting plate is pivotally mounted for rotational movement about the hinge pin 28 and is thus in movable assembly with the rigid base structure of the motor mount assembly.

The respective end portions of the parallel structural members 20 and 22 of the base 18 project beyond the pivot point established by the hinge pin 28 and define stop surfaces such as shown at 52 in FIG. 3. A pivot stop element 54 in the form of an elongate tubular member is welded or otherwise fixed to the lower portion of the motor mounting plate 42 and defines an upwardly facing positioning surface 56 which in the normal operating position of the protective motor mount assembly is disposed in positioning engagement with the stop surfaces 52 such as shown in full line in FIG. 3.

Figure 2:
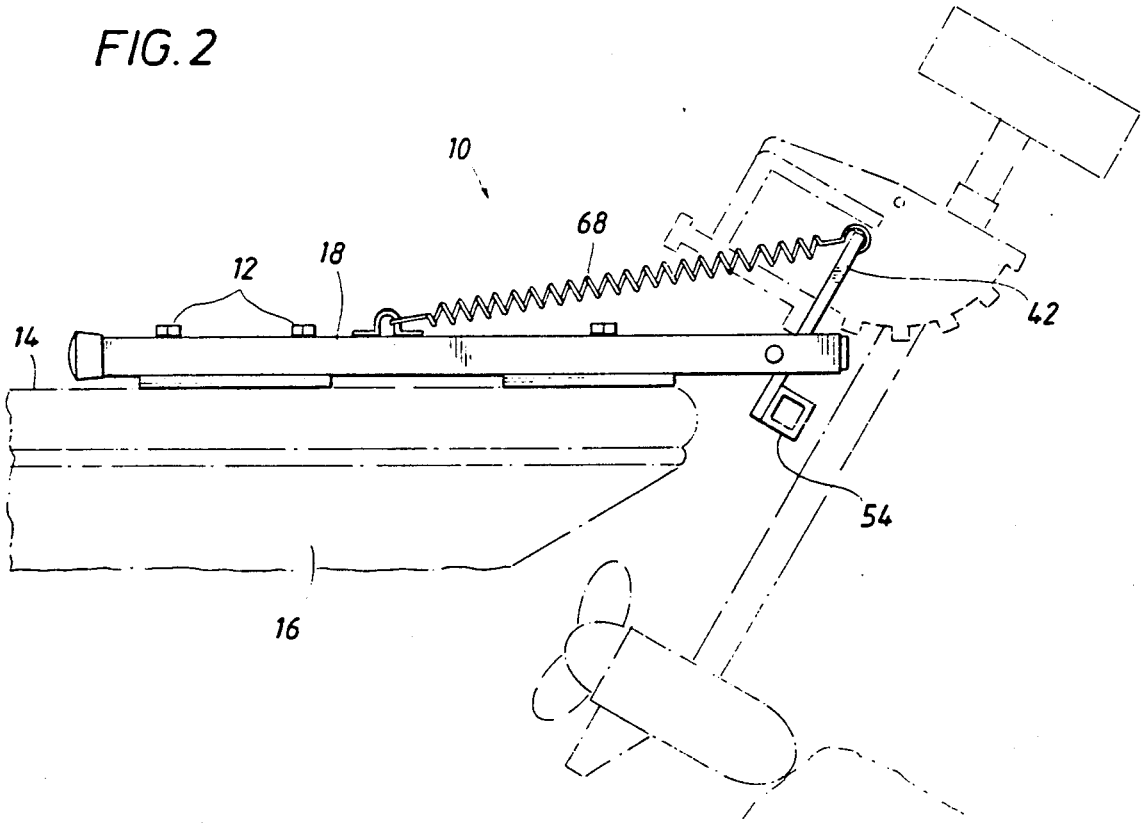

The clamp structure of a trolling motor support bracket, which is shown in broken lines in FIGS. 1 and 2, establish clamping engagement with the motor mounting plate 42 to thus establish releasable immovable support of the conventional trolling motor bracket assembly to the motor mounting plate 42. Thus, as the motor mounting plate 42 is moved pivotally about the hinge pin 28, the mounting bracket of the trolling motor assembly will be movable along with the motor mounting plate.

According to the teachings of the present invention, the protective yieldable motor mount of the present invention provides for yieldable pivotal movement of the trolling motor along with its mounting bracket, even though the mounting bracket does not permit motor pivoting, in the event forces above a predetermined minimum are induced to the trolling motor such as when a submerged object is struck during propulsion of the boat during normal fishing or other recreational activities. It is also appropriate according to the teachings of the present invention that the trolling motor mount of this invention be capable of maintaining the trolling motor at its preselected operative position for normal slow speed boat movement, such as during fishing activities, but pivotally yielding to provide protection to the trolling motor against bending of the shaft or other damage when a submerged object such as a log or shoal is encountered. One suitable means for accomplishing this feature is illustrated in FIGS. 1-5 wherein the motor mounting plate is urged to its operative position by the force of yieldable urging means. As shown in FIGS. 3 and 4, a pair of cleat members 58 and 60 are connected by screws 62 to the respective parallel structural elements 20 and 22 of the base structure. The cleat members 58 and 60 receive the end connection loops 64 and 66 of tension springs 68 and 70. At the upper portion of the motor mounting plate 42, there is provided spring connection apertures 72 and 74 that receive the opposed connection loops 76 and 78 of the tension springs 68 and 70 respectively. The tension springs are designed to apply a continuous force to the upper portion of the motor mounting plate 42 to thereby position the plate as shown in full line in FIG. 3, where the positioning surface 56 of the pivot stop element 54 is disposed in engagement with the stop surfaces 52. Thus, the motor mounting plate 42 is positioned in substantially normal relation with the parallel structural members 20 and 22. It should be born in mind that the motor mounting plate 42 may be positioned in any suitable relation with respect to the structural members 20 and 22 thus, normal positioning of the motor mounting plate as shown in FIG. 3 is not intended to limit the spirit and scope of this invention.

With a trolling motor bracket clamped to the motor mounting plate 42 and with a base structure 18 fixed to the deck structure of a boat, the trolling motor shaft at its normal operating position will be oriented in the manner shown in FIG. 1 with the motor shaft vertically or near vertically oriented as suits the needs of the user. The trolling motor bracket mechanism which is shown in broken lines and which does not form a part of this invention is typically provided with a shaft positioning sector having spaced slots and a slot engaging mechanism that allow the motor shaft to be positioned in various selected angular positions from substantially horizontal to substantially vertical. With the apparatus in the position shown in FIG. 1, the trolling motor may be energized to propel the boat at low speeds during fishing activities. In the event a submerged obstruction is encountered by the motor or motor shaft, the motor shaft will not be fixed as is conventionally the case, but rather will be yieldably movable about the pivot established by the hinge pin 28. The force applied by the resistance of the submerged object and the movement of the boat will apply sufficient force to the motor or motor shaft such that the tension of the springs 68 and 70 is overcome, thereby inducing elongation of the springs simultaneous with pivotal movement of the motor mounting plate 42 about the hinge pin 28. When this activity occurs, the trolling motor will be yieldably pivoted from the substantially vertical operating position shown in FIG. 1 to the yielded, pivoted position shown in FIG. 2. These positions of the motor mounting plate are illustrated in full line and broken line in FIG. 3. The forces applied by the tension springs 68 and 70 are designed to permit yieldable pivotal movement of the motor shaft before sufficient force thereto is capable of bending or otherwise damaging the motor shaft. Additionally, the tension force being applied to the motor mounted plate 42 by the springs 68 and 70 provide a braking activity to bring the boat from its slow propulsion speed to a full stop without permitting the motor shaft to be overstressed. When a submerged object is encountered, therefore, the motor will pivotally yield from the position shown in FIG. 1 to the position shown in FIG. 2 and the boat will come to a full stop. The operator of the boat will simply reverse the direction of motor propulsion to back the motor away from the submerged object. The motor can then be pivoted to a turning position relative to the boat and the motor can be again energized to steer the boat around the submerged object. During testing of the present invention, trolling motors have encountered many submerged objects and the trolling motor shaft has been effectively protected against bending or other damage to the trolling motor by the pivotal yieldable protective trolling motor mount of the present invention. This invention, therefore, is quite effective for its intended purpose.

Figure 6:
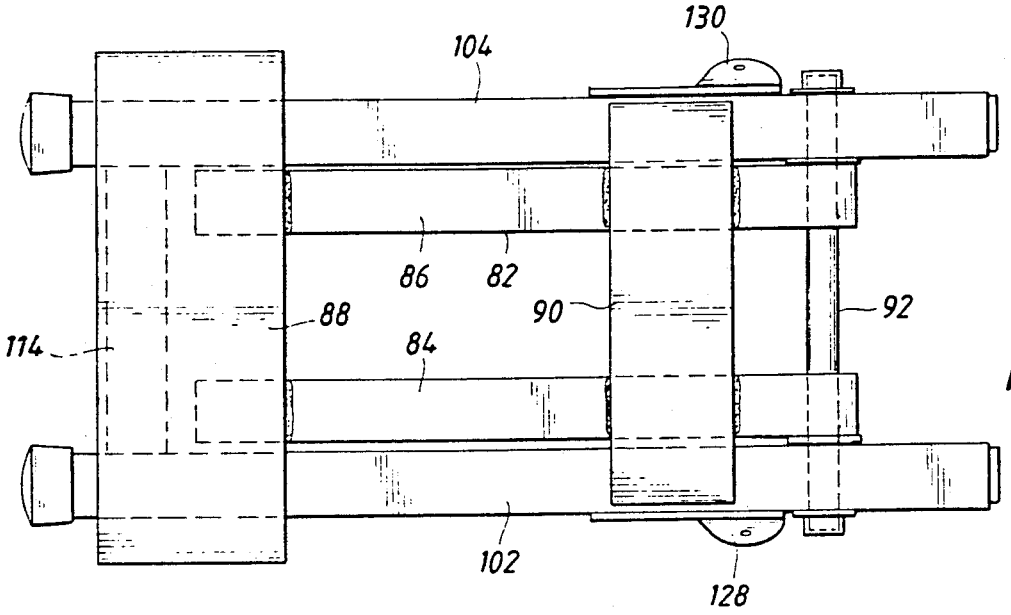
Figure 7:
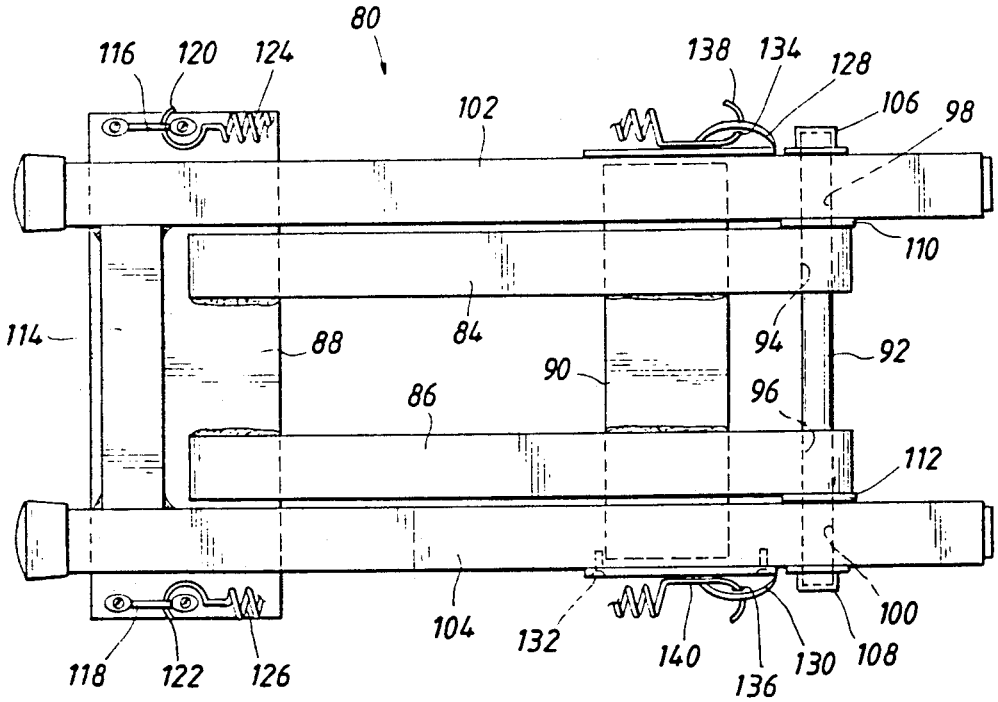
Figure 8:
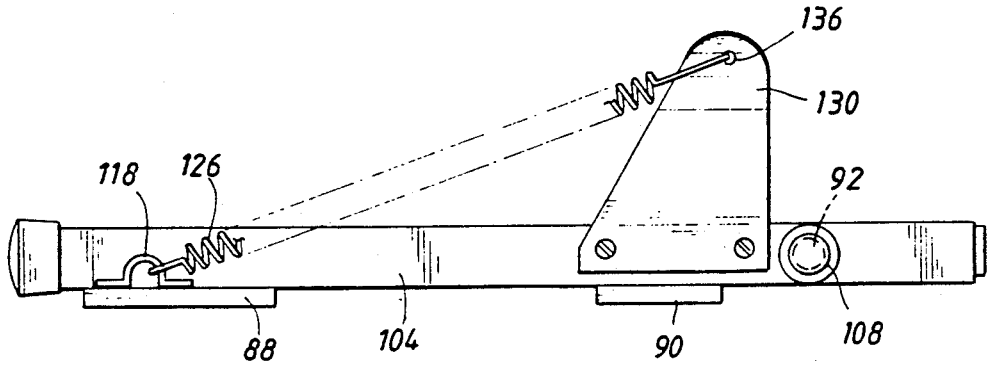

An alternative embodiment of the present invention is illustrated generally at 80 in FIGS. 6, 7 and 8 which includes a base structure 82 having a pair of generally parallel elongate structural members 84 and 86 having transverse base plates 88 and 90 fixed thereto by welding or by any other suitable means of connection. As shown in the bottom view of FIG. 6 a hinge pin 92 extends through apertures 94 and 96 of the structural members 84 and 86 with opposed end portions thereof being received by aligned apertures 98 and 100 of a pair of elongate structural members 102 and 104. A pair of push nuts 106 and 108 function to secure the hinge pin 92 against axial movement and washer members 110 and 112 are interposed between the relatively movable structural members and about the hinge pin 92. To the elongate parallel structural members 102 and 104 is affixed by welding or by any other suitable means a transverse cross member 114 which interconnects the structural members 102 and 104 and forms a substantially rigid framework.

A pair of cleat members 116 and 118 are connected by screws or by any other suitable means to the respective ends of the transverse structural member 88. The cleats are adapted to receive the connection loops 120 and 122 at the ends of tension springs 124 and 126. A pair of side plates 128 and 130 are connected respectively to the structural members 102 and 104 such as by means of screws 132 and provide apertures 134 and 136 that receive the connecting loops 138 and 140 at the opposite ends of the tension springs 124 and 126. The side plates 128 and 130 project upwardly from the respective structural members so that compression springs apply forces to the plate members that maintain the structural members 102 and 104 in engagement with the transverse structural members 188 and 190.

A trolling motor is mounted in any suitable fashion to the transverse structural members 102 and 104 and is maintained at its normal operation position by the tension of the springs 124 and 126. Upon encountering an obstruction, the trolling motor and its bracket assembly will apply a force to the structural members 102 and 104 which is translated by side plates 128 and 130 to the tension springs. Thus, the tension springs are elongated and the structural members 102 and 104, together with the trolling motor and motor bracket, are pivoted about the hinge pin 92. The spring resisting pivotal yielding of structural members 102 and 104 relative to the base structure permits protective pivotal yielding of the trolling motor to prevent damage thereto while at the same time, imparts a braking force to the fishing boat so that in a short distance, the boat will come to a full stop without overstressing the motor shaft. the motor shaft is protected against bending and other components of the trolling motor mechanism are also protected against damage.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A yieldable protective mounting mechanism for trolling motors that are intended for selected mounting at the bow or stern of small boats, which trolling motors have elongate motor shafts with an electric motor and propeller mechanism at the lower end of said motor shaft and a motor support and positioning bracket for supporting and positioning said shaft, said yieldable mounting mechanism comprising:

(a) a substantially flat mounting base adapted to be fixed in immovable relation to the structure of said boat, said mounting base having first spring connectors projecting laterally from opposed sides thereof;

(b) a motor support element adapted to receive said motor support and positioning bracket of said trolling motor in fixed relation therewith and having pivotal connection with said mounting base, said motor support element having second spring connectors on opposed sides thereof, said motor support element having a motor operating position relative to said mounting base and being pivotally movable from said motor operating position by forces transmitted through said trolling motor to said motor support element by submerged objects encountered by the motor or motor shaft of the trolling motor mechanism during operation thereof; and (c) a pair of tension springs each being interconnected at respective extremities thereof with said first and second spring connectors and continuously urging said motor support element to said operating position, said tension springs yielding when said forces exceed a predetermined minimum, thus permitting pivotal movement of said motor support element and the trolling motor secured thereto to protecting the shaft of the trolling motor from being bent or otherwise damaged upon encountering a submerged object.

2. The yieldable protective mounting mechanism of claim 1, wherein:

(a) said motor support element comprises a motor mounting plate which is adapted to receive said motor support and positioning bracket; and (b) hinge means being interconnected with said motor mounting plate and establishing said pivotal connection of said motor mounting plate to said substantially flat mounting base.

3. The yieldable protective mounting mechanism of claim 2, wherein:

(a) said mounting base defines stop means; and (b) a pivot stop element being provided on said motor mounting plate and defining a positioning surface for engagement with said stop means at said operating position of said motor mounting plate.

4. The yieldable protective mounting mechanism of claim 1, wherein said mounting base comprises:

(a) a pair of elongate generally parallel members defining aligned pivot pin receptacles;

(b) at least one transverse structural member interconnecting said elongate parallel structural members and defining a substantially rigid base frame work for fixed attachment to the deck of a fishing boat; and (c) a hinge pin being received by said aligned hinge pin receptacles, said hinge pin establishing pivotal relation of said motor support element to said mounting base structure.

5. The yieldable protective mounting mechanism of claim 4, wherein said motor support element comprises:

a motor mounting plate having at least one hinge member being pivotally received by said hinge pin.

6. The yieldable protective mounting mechanism of claim 5, wherein:

(a) said mounting base defines stop means;

(b) a pivot stop element is fixed to said motor mounting plate and defines a positioning surface for engagement with said stop means at said operating position of said motor mounting plate.

7. The yieldable protective mounting mechanism of claim 1, wherein said mounting base comprises:

(a) pair of elongate, generally parallel structural members having at least one transverse structural plate fixed thereto, said at least one transverse structural plate defining opposed end portions projecting laterally beyond said elongate substantially parallel member;

(b) said motor support element being defined by a pair of generally parallel elongate structural members adapted to receive a trolling motor in supported relation therewith; and (c) a pivot pin interconnecting said mounting base and motor support in pivotal assembly.

8. The yieldable protective mounting mechanism of claim 7, wherein said first spring connectors comprise:

(a) a pair of spring connection plates projecting laterally from opposed sides of said motor support element; and (b) said tension springs interconnecting said mounting base and said spring connection plates and continuously applying forces to maintain said motor support element at said operating position.

9. A yieldable protective mounting mechanism for trolling motors that are intended for selected mounting at the bow or stern of small boats, which trolling motors have elongate motor shafts with an electric motor and propeller mechanism at the lower end of said motor shaft and a motor support and positioning bracket for supporting and positioning said shaft, said yieldable mounting mechanism comprising:

(a) a substantially flat mounting base adapted to be fixed in immovable relation to the structure of said boat, said mounting base having first spring connectors projecting laterally from opposed sides thereof, said mounting base further defining stop means;

(b) a motor mounting plate adapted to receive said motor support and positioning bracket of said trolling motor in fixed relation therewith and having pivotal connection with said mounting base, said motor mounting plate having second spring connectors on opposed sides thereof, said motor mounting plate having a motor operating position in engagement with said stop means of said mounting base and being pivotally movable from said motor operating position by forces transmitted through said trolling motor to said motor support element by submerged objects encountered by the motor or motor shaft of the trolling motor mechanism during operation thereof;

(c) a pair of tension springs each being interconnected at respective extremities thereof with said first and second spring connectors and continuously urging said mounting plate to said operating position, said tension springs yielding when said forces exceed a predetermined minimum, thus permitting pivotal movement of said motor support element and the trolling motor secured thereto away from said stop means for protecting the shaft of the trolling motor from being bent or otherwise damaged upon encountering a submerged object; and (d) a pivot stop element being provided on said motor mounting plate and defining a positioning surface for engagement with said stop means at said operating position of said motor mounting plate.

10. The yieldable protective mounting mechanism of claim 9, wherein said mounting base comprises:

(a) a pair of elongate generally parallel members defining aligned pivot pin receptacles;

(b) at least one transverse structural member interconnecting said elongate parallel structural members and defining a substantially rigid base frame work for fixed attachment to the deck of said small boat; and (c) a hinge pin being received by said aligned hinge pin receptacles, said hinge pin establishing pivotal relation of said motor mounting plate to said substantially flat mounting base.

11. The yieldable protective mounting mechanism of claim 9, wherein said mounting base comprises:

(a) a pair of elongate, generally parallel structural members having at least one transverse structural plate fixed thereto, said at least one transverse structural plate defining opposed end portions projecting laterally beyond said elongate substantially parallel member;

(b) said motor support element being defined by a pair of generally parallel elongate structural members adapted to receive a trolling motor in supported relation therewith; and (c) a pivot pin interconnecting said mounting base and motor support in pivotal assembly.

12. The yieldable protective mounting mechanism of claim 11, including:

(a) a pair of spring mounting plates projecting laterally from said motor support element; and (b) said tension springs interconnecting said mounting base and said spring connection plates.

13. A yieldable protective mounting mechanism for trolling motors that are intended for selected mounting at the bow or stern of small boats which trolling motors have elongate motor shafts with an electric motor and propeller mechanism at the lower end of said motor shaft and a motor support and positioning bracket for supporting and positioning said shaft, said yieldable mounting mechanism comprising:

(a) a substantially flat mounting base adapted to be fixed in immovable relation to the structure of said boat, said substantially flat mounting base defining opposed sides and having first spring connectors projecting laterally from said opposed sides thereof;

(b) a motor mounting plate adapted to receive said motor support and positioning bracket of said trolling motor in fixed relation therewith and having hinge means defining pivotal connection thereof with said substantially flat mounting base, said motor mounting plate having second spring connectors projecting laterally from opposed sides thereof, said motor mounting plate having a motor operating position relative to said mounting base and being pivotally movable from said motor operating position by forces transmitted through said trolling motor to said motor mounting plate by submerged objects encountered by the motor or motor shaft of the trolling motor mechanism during operation thereof; and (c) a pair of tension springs each being interconnected at respective extremities thereof with said first and second spring connectors and continuously urging said motor mounting plate to said operating position, said tension springs yielding when said forces exceed a predetermined minimum, thus permitting pivotal movement of said motor mounting plate and the trolling motor secured thereto for protecting the shaft of the trolling motor from being bent or otherwise damaged upon encountering a submerged object.

14. The yieldable protective mounting mechanism of claim 13, wherein said mounting base comprises:

(a) a pair of elongate generally parallel members defining aligned pivot pin receptacles;

(b) at least one transverse structural member interconnecting said elongate parallel structural members and defining a substantially rigid base frame work for fixed attachment to the deck of said small boat; and (c) a hinge pin being received by said aligned hinge pin receptacles, said hinge pin establishing pivotal relation of said motor mounting plate to said substantially flat mounting base.

15. The yieldable protective mounting mechanism of claim 13, wherein said mounting base comprises:

(a) an elongate generally rectangular structural member having apertures formed therein to receive bolts for securing said structural member to said boat, said first spring connectors projecting laterally from opposed sides of said elongate generally rectangular structural member;

(b) said motor mounting plate being of generally rectangular configuration defining opposed sides;

(c) said second spring connectors being located near respective sides of said motor mounting plate; and (d) said tension springs being oriented along respective opposed sides of said structural member and said motor mounting plate and having respective ends thereof connected to respective first and second spring connectors, said tension springs having a preload force being sufficiently great to restrain said motor mounting plate at said motor operating position during normal trolling operation and yielding to permit pivotal movement of said motor mounting plate upon application of a force thereto exceeding said preload force.

16. The yieldable protective mounting mechanism of claim 13, wherein:

(a) said mounting base defines stop means; and (b) a pivot stop being provided on said motor mounting plate and defining a positioning surface for engagement with said stop means at said operating position of said motor mounting plate.

* * * * *